US007857663B2

(12) United States Patent
Chantrell et al.

(10) Patent No.: US 7,857,663 B2
(45) **Date of Patent: *Dec. 28, 2010**

(54) CONNECTOR ASSEMBLIES, COMBINATIONS AND METHODS FOR USE WITH FOIL-SHIELDED TWISTED PAIR CABLES

(75) Inventors: Thomas J. Chantrell, Westerly, RI (US); Michael J. Moldoch, Griswold, CT (US); William H. Dietz, Branford, CT (US)

(73) Assignee: Ortronics, Inc., New London, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/321,240

(22) Filed: Jan. 16, 2009

(65) Prior Publication Data

US 2010/0184331 A1 Jul. 22, 2010

(51) Int. Cl.
*H01R 9/03* (2006.01)

(52) U.S. Cl. ..... 439/607.41; 439/676

(58) Field of Classification Search ..... 439/462, 439/607.41, 701, 676, 314
See application file for complete search history.

(56) References Cited

U.S. PATENT DOCUMENTS

| | | | | |
|---|---|---|---|---|
| 5,752,849 | A | 5/1998 | Orlando | |
| 6,752,647 | B1 | 6/2004 | Lin | |
| 6,817,902 | B2 * | 11/2004 | Bernardi et al. | 439/676 |
| 6,935,886 | B2 * | 8/2005 | Hoch et al. | 439/462 |
| 6,948,971 | B2 * | 9/2005 | Bartholoma et al. | 439/462 |
| 7,214,094 | B2 * | 5/2007 | Kaminski et al. | 439/550 |
| 2005/0277335 | A1 | 12/2005 | Gordon et al. | |
| 2006/0246784 | A1 | 11/2006 | Aekins et al. | |
| 2007/0287332 | A1 | 12/2007 | Gordon et al. | |

FOREIGN PATENT DOCUMENTS

| | | |
|---|---|---|
| FR | 2829623 | 3/2003 |
| WO | 2008/081087 | 7/2008 |

OTHER PUBLICATIONS

Extended European Search Report dated Apr. 1, 2010.
PCT International Search Report and Written Opinion dated Mar. 22, 2010.

* cited by examiner

*Primary Examiner*—Khiem Nguyen
(74) *Attorney, Agent, or Firm*—McCarter & English, LLP

(57) ABSTRACT

Connector assemblies, combinations and methods for use in wiring/cabling applications are disclosed. Connector assemblies include openings that facilitate interaction between plugs and cables, particularly foil-shielded twisted pair (FTP) cables. Connector assembly sub-components and connector sub-assemblies are also disclosed. Connector assemblies and sub-assemblies include securely joined sub-components. Sub-components are secured to one another through the use of deflectable latching members of one sub-component engaging corresponding latching slots of another sub-component. Sub-components and sub-assemblies are secured to one another through the use of a cam nut engaged into a slot of a sub-component. Connector assemblies, combinations and methods including a cylindrical contact capable of engaging an FTP cable, drain wire and metal foil or sheath through the application of a cam nut are also disclosed.

42 Claims, 8 Drawing Sheets

CONNECTOR ASSEMBLIES, COMBINATIONS AND METHODS FOR USE WITH FOIL-SHIELDED TWISTED PAIR CABLES

BACKGROUND

1. Technical Field

The present disclosure is directed to connector assemblies, combinations and methods for use with electrical wires and cables. The disclosure is further directed to connector assemblies, combinations and methods that include a sub-assembly and are adapted for use with foil-shielded twisted pair (FTP) cables.

2. Background Art

Twisted pair cabling is a form of wiring in which two conductors (wires/cables) are wound together for the purposes of canceling out electromagnetic interference (EMI), electromagnetic radiation from unshielded twisted pair (UTP) wires/cables, crosstalk between neighboring pairs of cable/wire, or radiofrequency interference (RFI). Twisting wires/cables decreases interference because the loop area between the wires is reduced. In balanced pair operation, two wires/cables typically carry equal and opposite signals which are combined by addition at the destination. The common-mode noise from the two wires/cables helps to cancel each other because the two wires have similar amounts of EMI that are 180 degrees out of phase.

In order to further reduce interference and other sources of signal deterioration, electrical wires/cables often further include an insulating jacket surrounding each individual wire, a metal foil or braided sheath surrounding twisted wire/cable pairs and a drain wire. Twisted pair wires/cables are often shielded in attempt to prevent electromagnetic interference, but, because the shielding is made of metal, shielding may also serve as a ground. However, a shielded or screened twisted pair wire/cable usually has a special grounding wire added called a drain wire. A drain wire directs extraneous signals to ground. Shielding can be applied to individual wire/cable pairs, or to a collection of pairs. When shielding is applied to the collection of all pairs of wires/cables present, the shielding is referred to as screening. Shielding must usually be grounded for the shielding to function properly. Cables which include at least one twisted wire/cable pair (in which the wires/cables may be individually insulated), a drain wire, a metal foil or sheath surrounding the twisted pair(s) and drain wire, and an insulating jacket surrounding the wires/cables and the metal foil or sheath are commonly referred to as foil-shielded twisted pair (FTP) cables.

An FTP cable may be terminated by a connector assembly, such as a jack, that is adapted to operatively engage a mating connector, such as a plug. A jack typically includes a housing, sometimes made from several individual parts, that is manufactured from non-conductive material(s). A jack assembly may include a metal wrap to provide similar interference prevention as the metal foil or sheath in an FTP cable. Stated differently, a metal wrap in a jack housing, or other similarly functioning mechanism, may serve as a continuation of the foil wrap or shielding of an FTP cable, so that continuity of shielding is provided to and through the connection into the jack housing. In such shielded jacks, the drain wire of an FTP cable may be secured to the metal wrap. A mating shield plug may be engaged within a shielded jack, and the metal shield of the jack may contact the metal wrap of the jack, thereby providing electrical continuity.

An end user of a connector assembly (also known as a jack) is the installer. An end user typically connects an FTB cable to a corresponding jack manually—i.e., by physically exposing the wire/cable of the twisted pair(s), exposing the terminals located inside the jack housing if they are not already exposed, connecting the wires/cables to the terminals, and, finally, assembling the jack into its final form. The final form of a connector assembly commonly includes a covering or other protecting mechanism over the wire-terminal connections.

As an example, WO 2008/081087 discloses a socket to be mounted on a multi-conductor cable and includes a removable comb defining a central channel, a connection terminal block, and a screw and nut assembly. According to WO 2008/081087, the screw is fixedly mounted on the removable comb for axial translation and rotation relative the axis (X) of the socket. The terminal block includes two columns that prevent the rotation of the comb. The screw defines two helical slopes capable of engaging corresponding helical notches defined by the columns of the connection terminal block. As the screw is rotated, the helical slopes and helical notches interact and a torque is created. This torque causes translation between the screw and the terminal block, ultimately resulting in a secure connection between the screw, comb and terminal block.

It is important for an end user to securely connect the FTB wire/cable to the jack housing because a secure connection can prevent the FTB cable from pulling away from the housing and therefore cause the FTP twisted pair wires from disconnecting or disengaging from the terminals located inside the jack housing. As discussed above, to ensure proper functionality it is important that an end user securely engages the subcomponents of a jack to one another, provides continuity of shielding to and through the connection into the jack housing, and provides a secure connection between the terminals of the jack and the individual FTP wires. To further ensure proper functionality, it is also critical that the end user securely connects the FTP wires to the terminals located inside the jack housing.

Despite efforts to date, a need remains for connector assemblies, combinations and methods that provide enhanced FTP cable-to-jack connections. A need also remains for connector assemblies, combinations and methods that provide for improved connector assembly construction where each sub-component of the connector assembly can be easily secured to one another by an end user. Yet another need remains for connector assemblies, combinations and methods that provide enhanced FTP wire-to-terminal connections and shielding. These and other needs are satisfied by the connector assemblies, combinations and methods disclosed herein.

SUMMARY

The present disclosure is directed to connector assemblies, combinations and methods. The disclosed connector assemblies, combinations and methods may have particular utility in FTP cables or wiring applications, but the disclosure is not limited to such applications and/or limitations. In exemplary embodiments, the disclosed connector assemblies and sub-assemblies facilitate interaction between a wire or cable interacting with the connector assembly (also known as a jack) or sub-assembly and the wire or cable interacting with a plug. Thus, in an exemplary embodiment, the disclosed connector assemblies define a first jack that is configured and dimensioned to electrically cooperate with a first plug. In another exemplary embodiment, the disclosed connector assemblies define a first jack that is configured and dimensioned to electrically cooperate with a first plug and an FTP cable with a drain wire.

The disclosed connector assemblies, systems, combinations and techniques support enhanced cable-to-jack connection. The assemblies, systems, combinations and techniques also support enhanced assembly of jack sub-components and end user use. Stated differently, the disclosed jack configuration and design provides for a jack containing securely connected sub-components, a secure jack-FTP cable connection, and a jack that can be easily assembled and used by an end user.

The present disclosure also provides for connector assemblies and sub-assemblies including securely joined sub-components. The sub-components which makeup the disclosed connector assemblies and sub-assemblies may be secured to one another through the use of deflectable latching members and corresponding latching slots. Also, such connector assemblies and sub-assemblies may include sub-components secured to one another through the use of a cam nut engaged into a cam slot of a cam member which extends from sub-component and passes through several other sub-components. The disclosed connector assemblies, combinations and methods may also include a cylindrical contact capable of engaging an FTP cable, drain wire and metal foil or sheath through the application and rotation of a cam nut with cam threads engaged in a cam slot of a cam member extending from one sub-component and passing through other sub-components. In fact, the disclosed exemplary embodiments may include a cam nut which serves to (1) interface with a front assembly and securely mate the front assembly to a rear assembly and compete FTP wire-to-terminal connection, and (2) deflect a cylindrical contact to interfere with a drain wire and shielding of an FTP cable.

The disclosed sub-components include a jack housing, contact insert, printed circuit board (including plug connection elements and connection terminals), first sub-assembly housing, second sub-assembly housing, routing cap, cam nut and cylindrical contact.

Additional features, functions and benefits of the disclosed connectors, combinations and techniques will be apparent form the detailed description which follows, particularly when read in conjunction with the appended figures.

BRIEF DESCRIPTION OF FIGURES

To assist those of skill in the art in making and using the disclosed connectors, systems, combinations and techniques, reference is made to the accompanying figures, wherein.

DESCRIPTION OF EXEMPLARY EMBODIMENT(S)

Well-known functions or constructions may not be described in detail for brevity and clarity. As used herein, the term "drain wire" means an un-insulated wire in a cable that is in contact with a shield of the cable, such as a metal foil or sheath, throughout a major portion of its length. As used herein, the term "FTP wires" refers to the wires of at least one twisted pair of insulated or un-insulated wires in an FTP cable. As used herein, the term "FTP cable" refers to a cable that contains at least one twisted pair of insulated or un-insulated wires, a drain wire, a metal foil or sheath surrounding the twisted pair(s) and drain wire, and an insulating jacket surrounding the twisted pair(s) and the metal foil or sheath.

Figure 1:
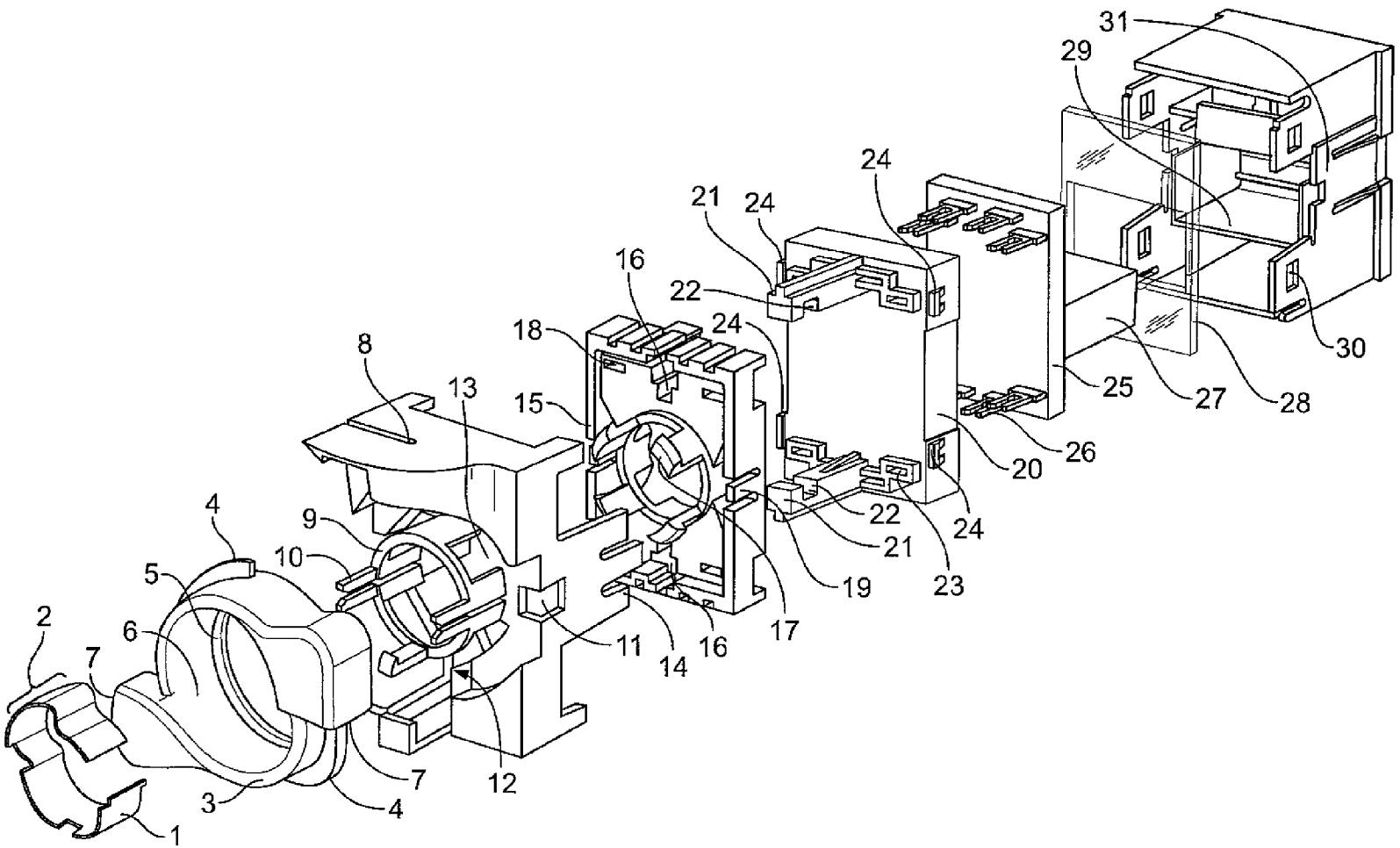
FIG. 1 is an exploded perspective view of an exemplary connector assembly according to the present disclosure.
Figure 2:
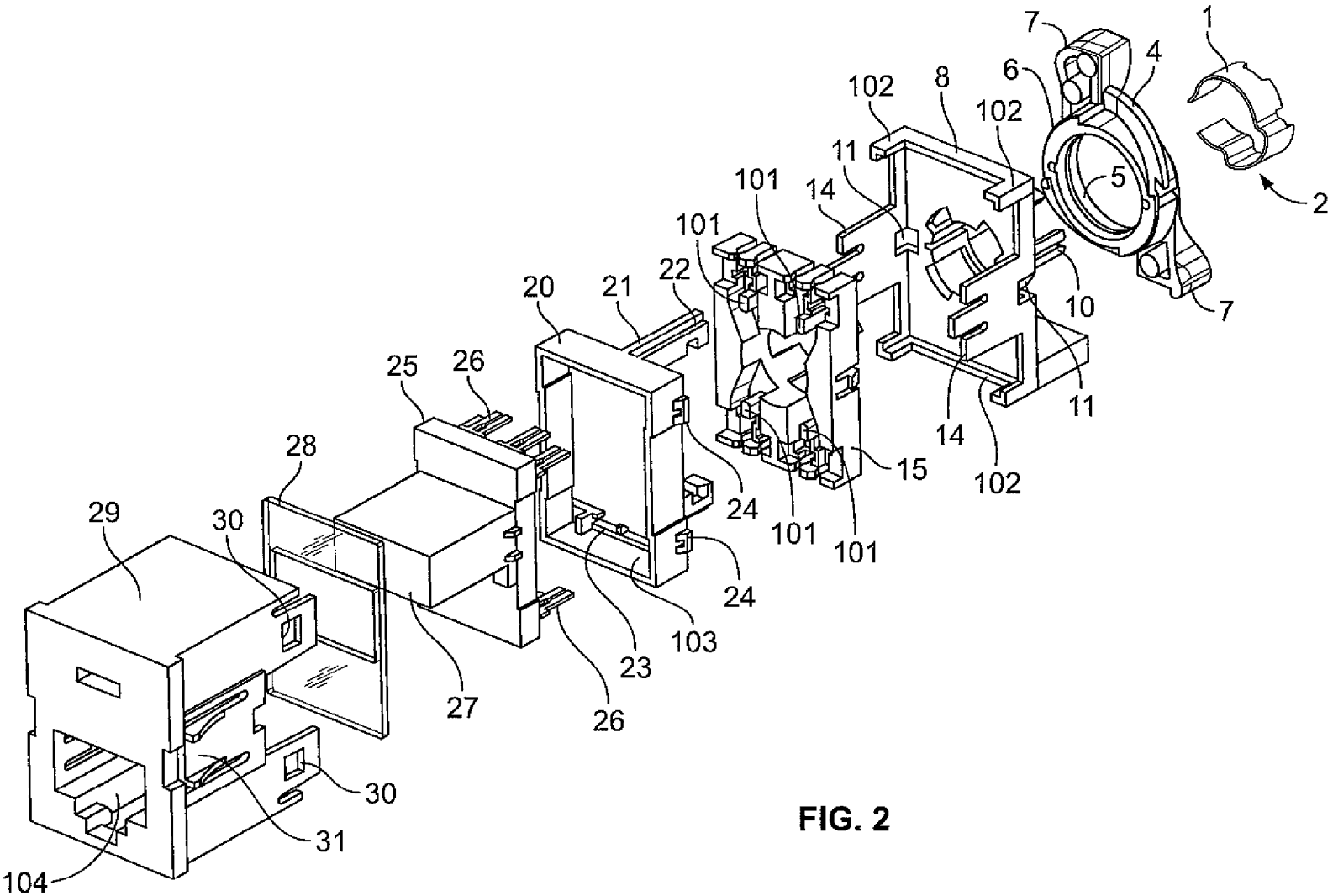
FIG. 2 is an exploded perspective view of an exemplary connector assembly according to the present disclosure viewed from the opposite direction as compared to the view of FIG. 1.

With reference to FIGS. 1 and 2, several exemplary connector assembly sub-components are disclosed. The disclosed exemplary sub-components are strictly exemplary and may be altered without departing from the spirit and scope of the present disclosure. Such alternative connector assembly sub-component embodiments are contemplated. Also, although the disclosed assemblies and figures depict several exemplary combinations of the sub-components, such sub-components may be combined through the use of alternative methods or designs without departing from the spirit and scope of the present disclosure. Such alternative connector assembly embodiments are contemplated.

Turning to FIG. 1, an exemplary connector assembly, in an exploded view, is disclosed. The exemplary connector assembly in FIG. 1 contains several exemplary sub-components. One such sub-component is exemplary cylindrical contact 1. Exemplary cylindrical contact 1 follows a general elliptical or circular shape and may be made from a conductive material. Exemplary cylindrical contact 1 is not continuous, i.e. the cylindrical contact contains a gap. Such gap in exemplary cylindrical contact 1 may allow exemplary cylindrical contact 1 to be "opened" or "closed", i.e., the circular or elliptical shape of cylindrical contact 1 may be made larger or smaller, respectively. The ability of cylindrical contact 1 to be "opened" or "closed" may allow cylindrical contact 1 to be adjusted to tightly or securely hold/contact an FTP cable, drain wire, metal foil or sheath, and combination thereof. Exemplary cylindrical contact 1 also contains an exemplary collar 2. Exemplary collar 2 is an area of cylindrical contact 1 that does not follow the elliptical or circular shape of cylindrical contact 1. Exemplary collar 2 may depart from the elliptical or circular profile of exemplary cylindrical contact 1 by defining a similar but larger elliptical or circular profile. Such exemplary collar 2 may allow a material to be passed through exemplary cylindrical contact 1 which does not follow the elliptical or circular inner area defined by exemplary cylindrical contact 1. As such, exemplary cylindrical contact 1 and collar 2 may allow an FTP cable to pass through exemplary cylindrical contact 1 while simultaneously allowing the FTP cable's drain wire or metal foil or sheath which has passed through exemplary cylindrical contact 1 to be re-diverted back through exemplary cylindrical contact 1 (through exemplary collar 2) and come into direct contact with exemplary cylindrical contact 1. Stated differently, exemplary collar 2 may allow a drain wire or metal foil sheath and an FTP cable to pass through exemplary cylindrical contact 1. The edges of exemplary cylindrical contact 1 may define a particular pattern, e.g., an edge or edges of exemplary cylindrical contact 1 may not be straight or flat. The shape of exemplary cylindrical contact 1 may also have several bends which depart from the general elliptical or circular shape. The profile of the edges and bends of exemplary cylindrical contact 1 may assist or allow exemplary cylindrical contact 1 to be held or otherwise joined to another connector assembly sub-component.

Cylindrical contact 1 may be shaped and designed so as to allow deflection or bias, thereby being capable of engaging an FTP cable, drain wire and metal foil or sheath. Such deflection may be achieved by the deflection of deflectable fingers or latching members engaging cylindrical contact 1. For example, cylindrical contact 1 may be deflectable by an inner diameter feature of a cam nut which interacts with deflectable fingers or latching members engaging cylindrical contact 1.

One such disclosed exemplary sub-component which may be capable of holding, connecting to, or otherwise being joined to an exemplary cylindrical contact is exemplary first sub-assembly housing 8. The exemplary embodiment of first sub-assembly housing 8 may include a cylindrical member 9 extending from a first face. Cylindrical member 9 may include fingers or deflectable latching members 10. The fingers or deflectable latching members 10 of an exemplary cylindrical member may correspond to the surface and edge profile of an exemplary cylindrical contact and thereby allow the cylindrical member and cylindrical contact to be coupled. Exemplary fingers or deflectable latching members 10 may also be flexible and may therefore transfer "opening" or "closing" forces onto an exemplary cylindrical contact engaged thereto. Stated differently, deflection of exemplary fingers or deflectable latching members 10 may bias cylindrical contact 1 and, as a result, cylindrical contact 1 may interfere or contact a drain wire, metal foil sheath, an FTP cable or combinations thereof. Exemplary first sub-assembly housing 8 and fingers or deflectable latching members 10 may shaped and designed so allow deflection of fingers or deflectable latching members 10 (resulting in deflection of cylindrical contact 1) through interaction of another component. For example, exemplary first sub-assembly housing 8 and fingers or deflectable latching members 10 may be shaped and designed to allow deflection by the interaction of a cam nut.

Cylindrical member 9 may define an opening though exemplary first sub-assembly housing 8. Such opening may facilitate an FTB cable or FTP wires to pass through first sub-assembly housing 8. Cylindrical member 9 may also define a latching slot 13. Latching slot 13 may be engaged by another component, including a deflectable latching member facilitate a secure connection to between the first sub-assembly housing and another component. Exemplary first sub-assembly housing 8 may also include at least one deflectable latching member 14. Such deflectable latching member 14 can engage latching slots to members formed in another cooperative connector assembly component. Additional latching structures (not shown) may be provided on exemplary first sub-assembly housing 8, e.g., along the bottom or top surfaces thereof, to further facilitate a secure connection to another component. Exemplary first sub-assembly housing 8 also includes at least one latching slot 11. Such latching slot 11 may be engaged by another component, including a deflectable latching member. Additional latching slots (not shown) may be provided on exemplary first sub-assembly housing 8, e.g., along the bottom or top surfaces thereof, to further facilitate a secure connection to another component. As shown in FIG. 2, exemplary first sub-assembly housing 8 may further be designed to accept the attachment of a connector sub-component by defining a frame, housing or ledge (s) 102 for the sub-component on a second face (opposite of the face containing the cylindrical member).

An exemplary cylindrical member extending from a first face of an exemplary first sub-assembly housing may also be designed to allow for a cam nut to be positioned thereon. As shown in FIG. 1, exemplary cam nut 3 has an inner opening 6 that corresponds to the cylindrical member onto which cam nut 3 is positioned. The inner diameter may be sized and dimensioned to fit over a cylindrical member and allow an FTP cable or FTP wires to pass through the cam nut or cylindrical member. Exemplary cam nut 3 may also include an inner diameter feature 5. Inner diameter feature 5 may allow cam nut 3 to deflect the cylindrical member, fingers or deflectable latching members located thereon, and a cylindrical contact if attached to the fingers or deflectable latching members. This functionality may be achieved, for example, if the outer diameter defined by the cylindrical member varies and, at some location, is larger than the inner diameter feature of the cam nut. In this exemplary scenario, when the can nut is positioned over the larger diameter area, the cam nut would depress the fingers or deflectable latching members and a cylindrical contact located thereon.

As shown in FIGS. 1 and 2, an exemplary sub-component that may attach or mate with a first sub-assembly housing is exemplary routing cap 15. Turning to FIG. 1, exemplary routing cap 15 may include a deflectable latching member 19. Deflectable latching member 19 may engage a latching slot in another component thereby facilitating a secure connection between the exemplary routing cap 15 and another component. For example, routing cap 15 may be joined to first sub-assembly housing 8 as the latching member 19 corresponds to latching slot 11. Exemplary routing cap 15 may also include a ring of fingers or deflectable latching members 17 extending from a first surface. The ring of fingers or deflectable latching members 17 of the exemplary routing cap may correspond to latching slots in a cylindrical member of an exemplary sub-component and thereby allow the routing cap and corresponding sub-component to be coupled. For example, routing cap 15 may be joined to first sub-assembly housing 8 as the ring of latching members 17 corresponds to latching slots 13. The fingers or deflectable latching members 17 may also define an opening though exemplary routing cap 15. Such opening may facilitate an FTB cable or FTP wires to pass through exemplary routing cap 15. Further, routing cap 15 may include terminal slots 18 that allow terminals 26, which may protrude from PCB 25, to pass through, at least in part, routing cap 15. Turning to FIG. 2, exemplary routing cap 15 may include wire routing channels 101 on a second surface (opposite of the face containing the ring of fingers or deflectable latching members). Such exemplary routing channels 101 may guide FTP wires to pre-determined positions. Exemplary routing channels 101 may also prevent shorting of FTP wires or assist in interference prevention.

The present disclosure also provides an exemplary jack housing 29. As shown in FIG. 2, exemplary jack housing 29 defines a first plug/jack opening 104 on a face thereof. An exemplary label slot is also defined above jack opening 104. The exemplary label slot permits an end user to label the electrical connection associated with the connector assembly for future reference. Alternative labeling techniques may be employed, as are known in the art.

As shown in FIG. 1, exemplary jack housing 29 also defines a rear opening and boundary that may be further divided and/or include members or other structures therein. Exemplary jack housing 29 may include a deflectable latching member 31. Deflectable latching member 31 may engage a latching slot or member in another component thereby facilitating a secure connection between the exemplary jack housing 29 and another component. For example, exemplary jack housing 29 may be joined to first sub-assembly housing 8 as the latching member 31 corresponds to latching member 14. Exemplary jack housing 29 may also define at least one latching slot 30. Latching slot 30 may be engaged by another component, including a deflectable latching member, to facilitate a secure connection between the first sub-assembly housing and another component. As an example, exemplary jack housing 29 may be joined to second sub-assembly housing 20 as the latching members 24 correspond to latching slots 30.

A contact insert 28 may extend into the rear opening formed in exemplary jack housing 29 and defines, in part, a boundary of the jack opening formed in second exemplary jack housing 29. A printed circuit board (PCB) 25 may also be positioned into the rear opening formed in exemplary jack housing 29 and abut contact insert 28. Exemplary PCB 25 may include conventional electronic elements, e.g., traces printed or etched on a non-conductive substrate that facilitate electrical connection across the connector assembly. Exemplary PCB 25 may also include conventional plug connections elements 27. Such conventional plug connection elements 27 may be designed to electrically cooperate with and engage a plug inserted into plug/jack opening 104 and may continue such electrical connection to exemplary PCB 25. The electrical connection and signal carried from an inserted plug may terminate on exemplary PCB 25 with terminals 26. Exemplary terminals 26 may be made from electrically conductive material and designed to accept connection with FTP wires. Exemplary terminals 26 may be "U" or "V" shaped thereby allowing an FTP wire to be pressed into each exemplary terminal and be securely joined or held by the exemplary terminal. In another exemplary design, exemplary terminals 26 may include a channel and opening, wherein the channel is less wide than the diameter of an FTP wire but the opening is slightly wider than the channel.

Exemplary PCB 25 and its components may be secured to exemplary jack housing 29 by another component which abuts the surface of PCT 25 and is latched to exemplary jack housing 29. As an example shown in FIG. 2, exemplary jack housing 29 may be joined to second sub-assembly housing 20 as the latching members 24 correspond to latching slots 30. When such connection is made, contact insert 28 and PCB 25 (including plug connection elements 27 and, at least in part, terminals 26) are securely held and contained in jack housing 29. Such connection may be further facilitated by the design of second sub-assembly housing 20. Exemplary second sub-assembly housing 20 may contain frames or ledges 103 that define a compartment in which PCB 25 can be securely housed. Further, exemplary second sub-assembly housing 20 may include terminal slots 23 that allow terminals 26, which may protrude from PCB 25, to pass through second sub-assembly housing 20 and allow the surface of PCB 20 to abut a face of second sub-assembly housing 20.

Exemplary second sub-assembly housing 20 is another exemplary connector assembly sub-component. As discussed above, exemplary second sub-assembly housing 20 may securely hold contact insert 28 and PCB 25 (including plug connection elements 27 and, at least in part, terminals 26) to the jack housing 29 by latching members 24. Exemplary second sub-assembly housing 20 may also include cam member(s) 21. Cam member(s) 21 is/are element(s) that extend from a face of second sub-assembly housing 20. The exemplary cam member(s) 21 extend from a face opposite the side of second sub-assembly housing 20 that faces exemplary jack housing 29. As such, cam member(s) 21 extend away from exemplary jack housing 29. Cam member(s) 21 may be sized, shaped and dimensioned so that they may pass through several other sub-components. Cam member(s) 21 may also include a cam slot 22 which encompasses a slot located near the end of cam member(s) 21. Cam slot 22 may be a straight, curved or angled slot.

In order for a cam member 21 of second sub-assembly housing 20 to extend or pass through another sub-component, the other sub-component may define a hole therein which mimics or resembles the shape of cam member 21. For example, as shown in FIG. 1, cam members 21 of second sub-assembly housing 20 can pass through routing cap 15 via cam member gaps 16 and first sub-assembly housing 8 via cam member gaps 12 (the top cam member gap 12 cannot be seen due to the angle of view). When cam members 21 have passed through routing cap 15 and first sub-assembly housing 8, cam slots 22 may be located a certain distance past the surface of first sub-assembly housing 8. With reference to this state (the cam members passing through sub-components and the cam slots being exposed), cam thread(s) 4 located on the outer surface of cam nut 3 may interface with cam member(s) 21 by engaging cam slot(s) 22.

As discussed above, exemplary cam nut 3 may include exemplary cam threads 4 formed on the outside surface around at least a portion of exemplary cam nut 3. Each exemplary cam thread 4 may define a ridge extending from the surface of exemplary cam nut 3 and may be oriented on an angle or curve—similar to a singular thread of a common screw. Exemplary cam nut 3 may also include one or more cam stop members 7 which extend from the outer surface of exemplary cam nut 3 and borders the end of cam threads 4 which is positioned farthest from the face of first sub-assembly housing 8 when positioned on cylindrical member 9 of first sub-assembly housing 8. When exemplary cam nut 3 is positioned on cylindrical member 9 and cam threads 4 engage cam slots 22, cam nut 3 may be rotated and, because of the angle of cam threads 4, torque will be created and cam nut 3 will pull together and secure second sub-assembly housing 20, routing cap 15 and first sub-assembly housing 8. Also, because jack housing 29, contact insert 28 and PCB 25 may be connected to second sub-assembly housing 20, the rotation of cam nut 3 may secure these sub-components to routing cap 15, first sub-assembly housing 8 and cylindrical contact 1, thereby forming a fully constructed connector assembly. Cam stop members 7 may prevent cam nut 3 from over-rotating off cam threads 4.

As exemplary cam nut 3 is rotated, cam nut 3 may be translated towards, and finally come in contact with, the surface of first sub-assembly housing 8. As cam nut 3 shifts positions on cylindrical member 9, cam nut 3 may deflect or compress fingers or deflectable latching members 17 and, thereby, compress or deflect cylindrical contact 1. The deflection of fingers or deflectable latching members 17 may result from the shape and design of exemplary fingers or deflectable latching members 17, first sub-assembly housing 8, cylindrical member 9, the inner diameter of cam nut 3 or a combination thereof. In such an embodiment, an FTP cable may have previously been fed through cylindrical contact 1, first sub-assembly housing 8 and into routing cap 15. Also, FTP wires from the FTP cable may have been engaged into terminals 26 and positioned into wire routing channels 101. In addition, the drain wire and metal foil or sheath may have been redirected back through cylindrical contact 1 passing through the FTP cable and collar 2. As such, rotation of cam nut 3 may jointly (1) engage connector sub-components, and (2) compress cylindrical contact 1, possibly on an FTP cable, drain wire or metal foil or sheath.

In such an embodiment, cylindrical contact 1 may provide continuity and shielding of the FTP wires to the connector assembly entrance. Stated differently, rotation of cam nut 3 may simultaneously result in (1) secure assembly of jack sub-components, and (2) interference or contact between a cylindrical contact and a FTP cable, drain wire or shielding.

As may be recognized by those of ordinary skill in the pertinent art based on the teachings herein, the contact which is biased into the FTP cable, drain wire or shielding may take any of numerous different shapes or configurations that are currently known, or that later become known. For example, rather than a cylindrical contact, a lever type contact may be coupled to the connector assembly and biased or urged into contact with the FTP cable, drain wire or shielding by rotation and/or translation of the cam nut. The lever type contact may, for example, be an elongate, substantially linear contact with a curvilinear profile or an elongate "L" shaped contact. As another example, rather than the contact being coupled to the jack on deflectable members extending from a face of a component of the connector assembly, at least one end of a contact, such as one of the two alternative contact embodiments discussed above, may be coupled to another portion of the connector assembly component which may or may not be deflectable or biased by rotation or translation of the cam nut. In such an exemplary embodiment, the contact itself may be deflectable and/or shaped, dimensioned or positioned such that rotation or translation of the cam nut biases the contact into the FTP cable, drain wire or shielding. For example, an elongate, non-cylindrical deflectable contact may define at least one end coupled to the connector assembly component and a free end distally spaced relative to the component which is biased into contact with the FTP cable, drain wire or shielding by rotation or translation of the cam nut.

Figure 3A:
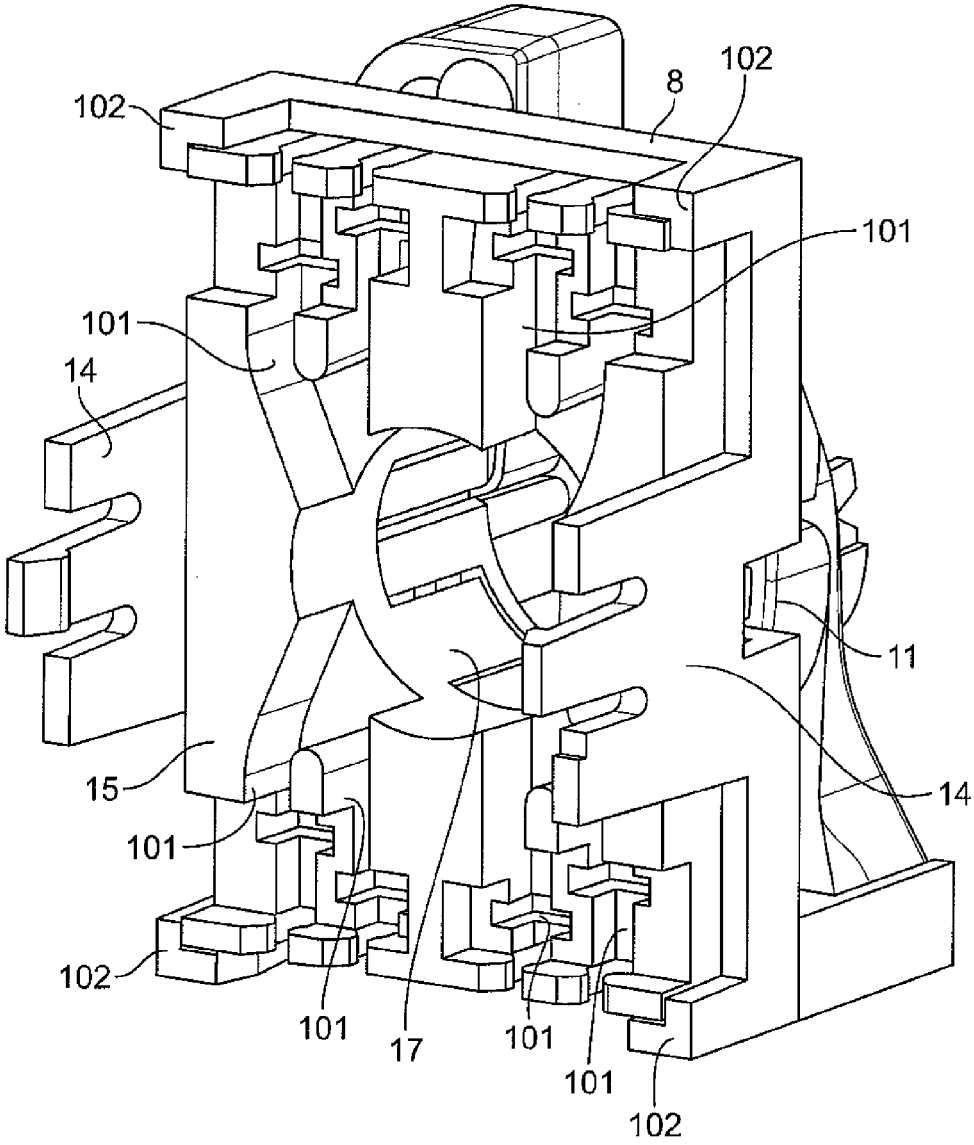
FIG. 3A is a perspective view of an exemplary first connector sub-assembly according to the present disclosure.
Figure 3B:
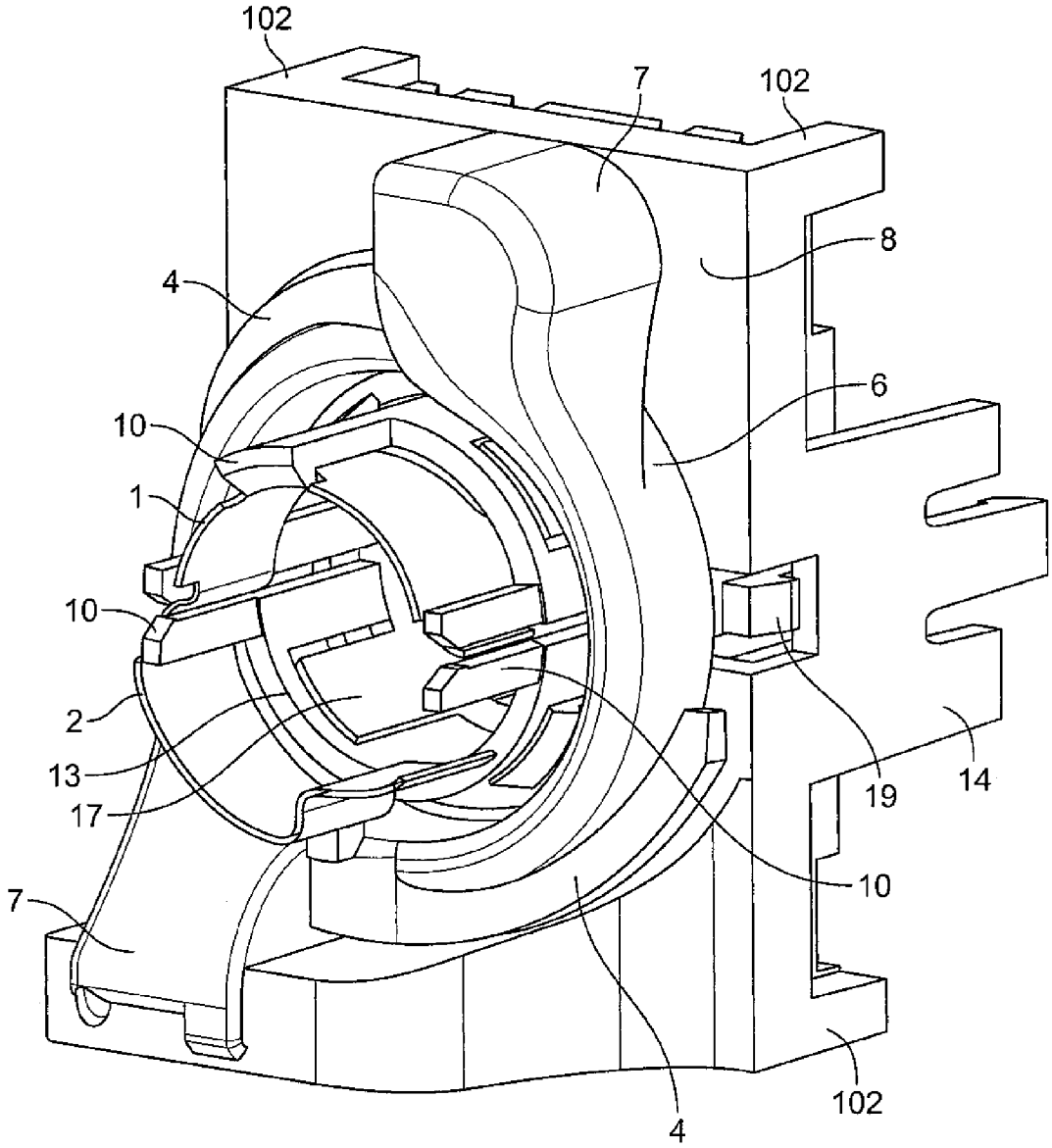
FIG. 3B is a perspective view of the exemplary first connector sub-assembly of FIG. 3A viewed from the opposite direction as compared to the view of FIG. 3A.

As discussed above, several of the disclosed connector sub-components can by joined to one another, mostly through the use deflectable latching members and corresponding latching slots. FIGS. 3A and 3B depict an exemplary first connector sub-assembly. The disclosed sub-assembly includes an entrance for an FTB cable and FTB wires. The exemplary first connector sub-assembly includes routing cap 15, first sub-assembly housing 8, cam nut 3 and cylindrical contact 1. Routing cap 15 may be secured to first sub-assembly housing 8 by the interaction of deflectable latching members 19 and latching slots 11. Frame, housing or ledges 102 may also assist in securing routing cap 15 to first sub-assembly housing 8. Still further, routing cap 15 and first sub-assembly housing 8 may be joined by the interaction of ring of fingers or deflectable latching members 17 and latching slots 13.

Figure 4A:
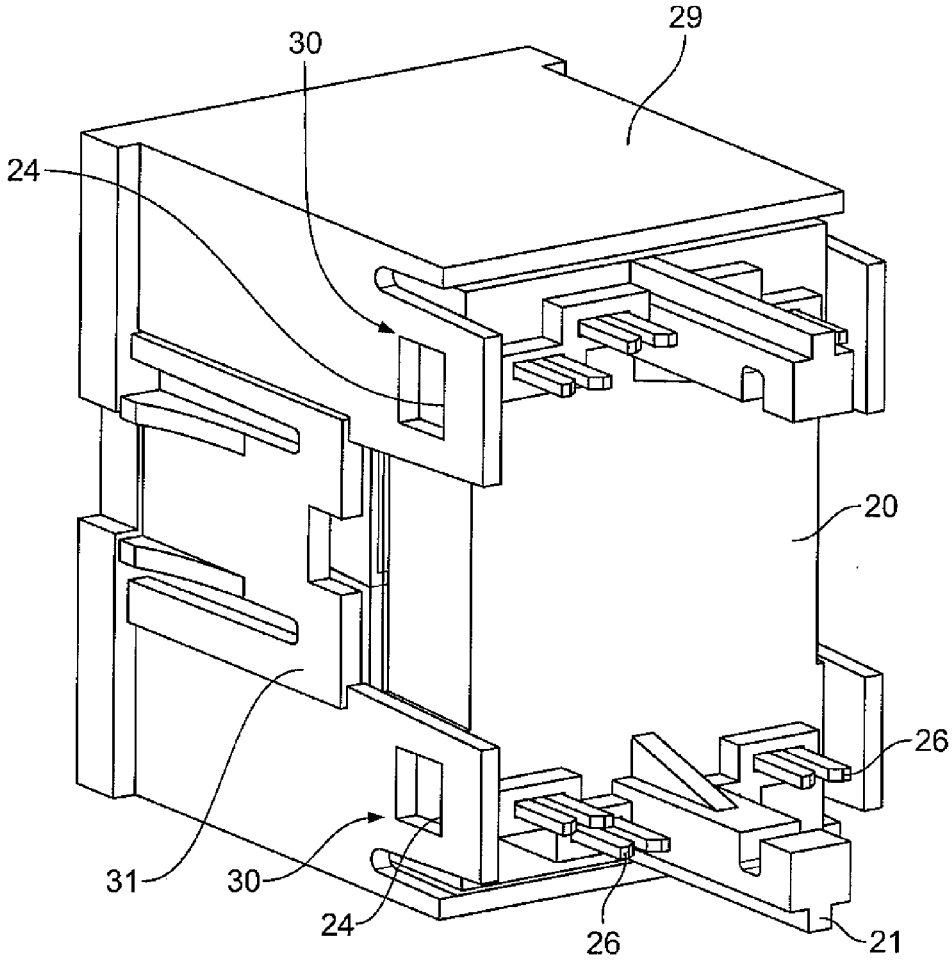
FIG. 4A is a perspective view of an exemplary second connector sub-assembly according to the present disclosure.
Figure 4B:
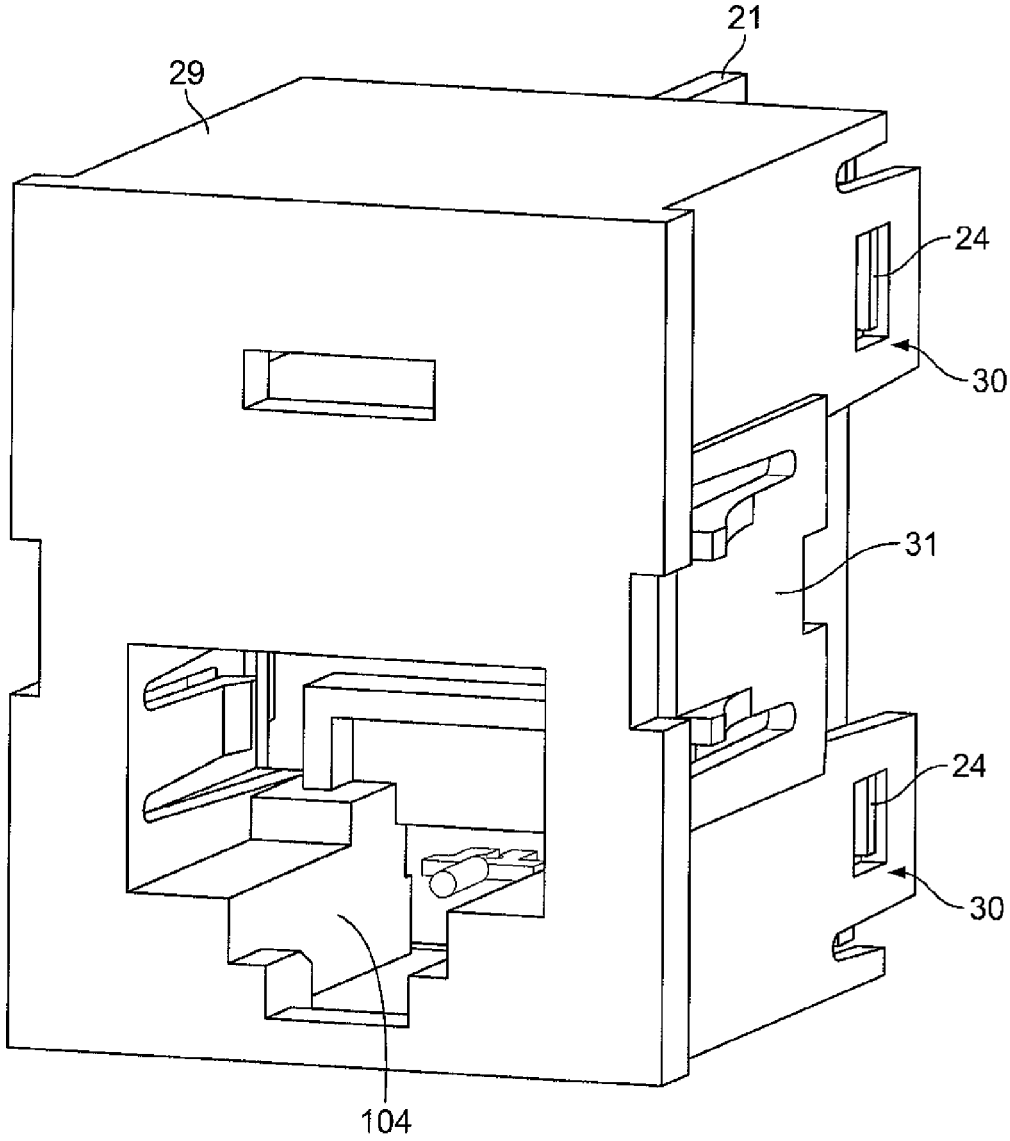
FIG. 4B is a perspective view of the exemplary second connector sub-assembly of FIG. 4A viewed from the opposite direction as compared to the view of FIG. 4A.

FIGS. 4A and 4B depict an exemplary second connector sub-assembly. The disclosed sub-assembly includes a jack housing 29 with an entrance for an electrical plug 104, a second sub-assembly housing 20, contact insert 28 and PCB 25 (including plug connection elements 27 and terminals 26). The second sub-assembly housing 20 and jack housing 29 are joined by the interaction of deflectable latching members 24 and latching slots 30. Contact insert 28 and PCB 25 (including plug connection elements 27 and terminals 26) are secured in the second sub-assembly by being encased or housed inside the area defined by the jack housing 29 and second sub assembly housing 20.

Figure 5A:
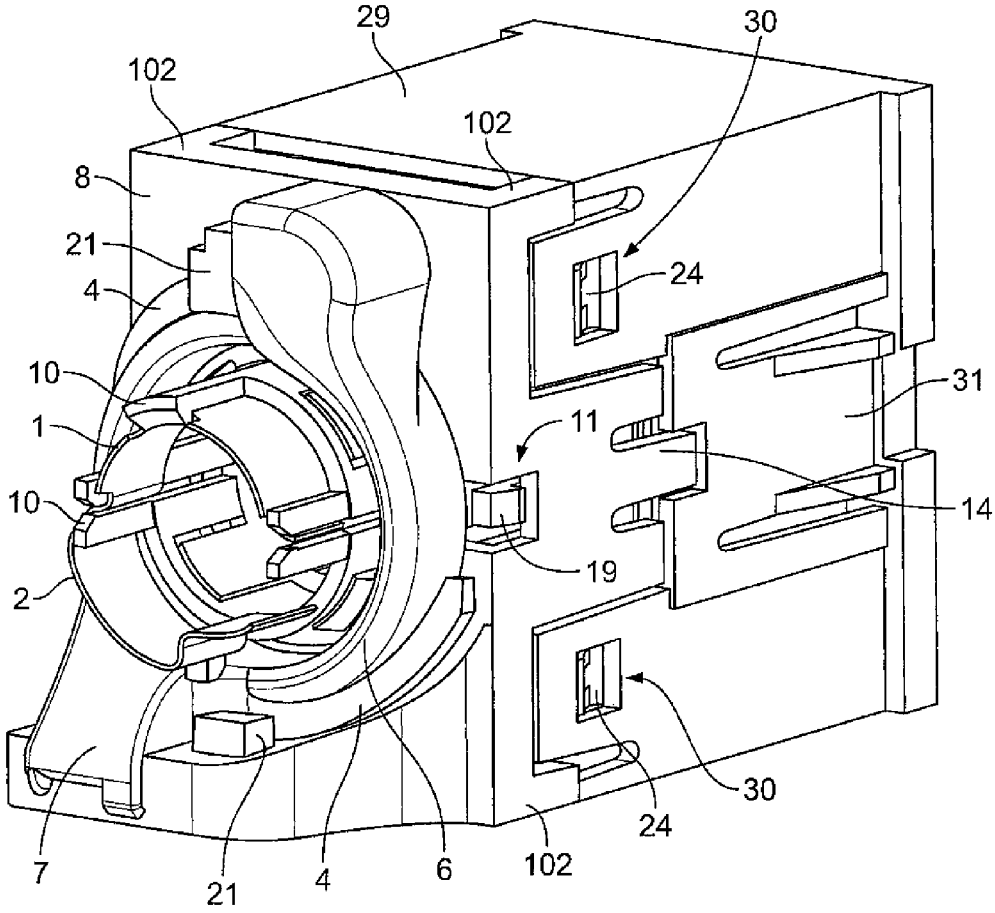
FIG. 5A is a perspective view of an exemplary connector assembly formed by the interaction of the exemplary first connector sub-assembly of FIGS. 3A and 3B and the exemplary second connector sub-assembly of FIGS. 4A and 4B.
Figure 5B:
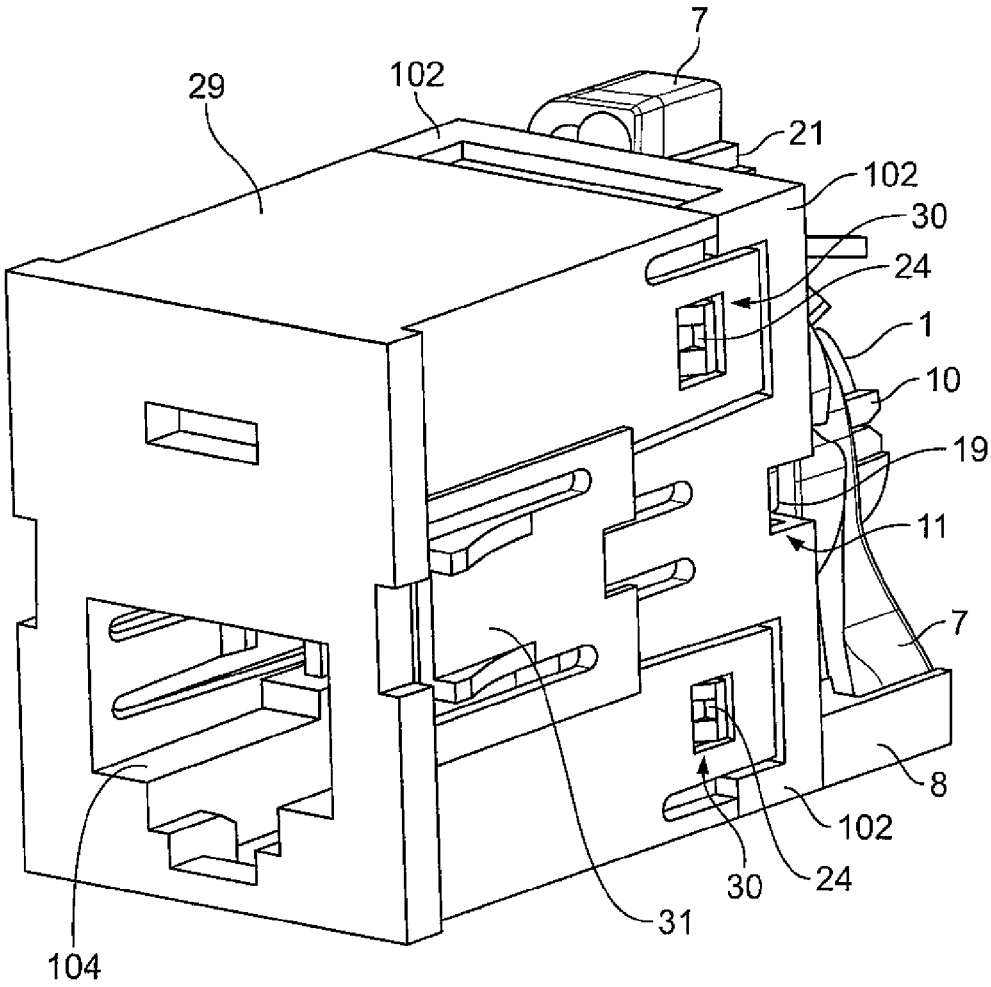
FIG. 5B is a perspective view of the exemplary connector assembly of FIG. 5A viewed from the opposite direction as compared to view of FIG. 5A.

As discussed above and as shown in FIGS. 5A and 5B, exemplary first connector sub-assembly and exemplary second connector sub-assembly can be joined to form a constructed connector assembly. The first connector sub-assembly and second connector sub-assembly may be joined by the interaction of deflectable latching members 14 and 31. The first connector sub-assembly and second connector sub-assembly may also be joined by the interaction and rotation of cam threads 4 on cam nut 3 and the cam slot 22 of cam member 21. If an FTP cable was fed through cylindrical contact 1 and the drain wire and metal foil or sheath of the FTB cable was redirected through the FTP cable and collar 2, the interaction and rotation of cam threads 4 on cam nut 3 and the cam slot 22 of cam member 21 would deflect the cylindrical contact 1 to interfere with the drain wire and metal foil or sheath. FTB wire may also be fed through the opening in the first sub-assembly housing 8 and routing cap 15 (not shown—see FIG. 1), along routing channels 101 (not shown—see FIG. 2) and engaged with terminals 26 before the first and second sub-components are joined to form a fully constructed connector assembly.

Although the present disclosure discloses and describes exemplary connector assembly embodiments and associated assembly techniques, it is to be understood that the present disclosure is neither limited by or to such exemplary embodiments. Rather, the disclosed connector assembly embodiments and associated assembly techniques are merely illustrative. Various modifications, variations and/or enhancements to the disclosed connector assembly embodiments/techniques may be made without departing from the spirit or scope of the present disclosure.

The invention claimed is:

1. A connector assembly, comprising:

a. a jack housing defining a plug opening and a first opening;

b. a first connector sub-assembly housing detachably coupled to said jack housing in proximity to the first opening, wherein said first connector sub-assembly housing includes a cam member that defines a cam slot;

c. a routing cap that defines at least one routing channel, an opening sized and dimensioned to allow at least one wire pair to pass through said opening, and a first cam opening sized and dimensioned to allow said cam member to pass through said first cam opening;

d. a second sub-assembly housing detachably coupled to said routing cap, wherein said second sub-assembly housing includes a cylindrical member defining a cylindrical opening sized and dimensioned to allow at least one wire pair to pass through said opening, and a second cam opening sized and dimensioned to allow said cam member to pass through said second cam opening;

e. a cam nut mounted with respect to said cylindrical member, wherein said cam nut defines at least one cam thread, and wherein said at least one cam thread is configured and dimensioned to interact with said at least one cam slot; and f. a contact coupled with respect to the second sub-assembly housing.

2. A connector assembly according to claim 1, wherein the plug opening and the first opening are oppositely directed.

3. A connector assembly according to claim 1, wherein the contact includes a conductive material.

4. A connector assembly according to claim 1, wherein the contact includes a collar.

5. A connector assembly according to claim 4, wherein the collar is sized and shaped so as to allow the contact to accept a foil-shielded twisted pair (FTP) cable.

6. A connector assembly according to claim 1, wherein the cam nut further includes at least one cam stop member.

7. A connector assembly according to claim 1, wherein the connector assembly is shielded.

8. A connector assembly according to claim 1, wherein the cylindrical member includes one or more fingers or deflectable latching members.

9. A connector assembly according to claim 8, wherein the contact is detachably coupled to the cylindrical member of the second sub-assembly housing by the one or more fingers or deflectable latching members.

10. A connector assembly according to claim 9, wherein the inner diameter of the cam nut and outer diameter of the cylindrical member are sized and shaped to allow the cam nut to deflect said one or more fingers or deflectable latching members inward and thereby deflect said contact inward.

11. A connector assembly according to claim 10, wherein the contact engages an FTP cable, drain wire and wire foil or sheath when said contact is deflected.

12. A connector assembly according to claim 1, wherein the contact is coupled to the second sub-assembly housing but not the cylindrical member, the second sub-assembly housing and the cylindrical member, or exclusively to the cylindrical member.

13. A connector assembly according to claim 12, wherein the inner diameter of the cam nut is sized and shaped to deflect said second free end of the contact toward the center of the cylindrical opening.

14. A connector assembly according to claim 13, wherein the contact engages an FTP cable, drain wire and wire foil or sheath when said contact is deflected.

15. A connector assembly according to claim 12, wherein the contact is an elongate member defining at least a first coupled end and a second free end.

16. A connector assembly according to claim 15, wherein the first coupled end is coupled to the second sub-assembly housing and the second free end is physically spaced relative to the first end.

17. A connector assembly according to claim 16, wherein the inner diameter of the cam nut is sized and shaped to deflect said second free end of the contact toward the center of the cylindrical opening.

18. A connector assembly according to claim 17, wherein the contact engages an FTP cable, drain wire and wire foil or sheath when said contact is deflected.

19. A connector assembly according to claim 1, wherein rotation of the cam nut and cam threads securely couple the first connector sub-assembly housing, routing cap, second connector sub-assembly housing and said cam nut.

20. A connector assembly according to claim 19, wherein rotation of the cam nut further results in deflection of said contact inward.

21. A connector assembly according to claim 20, wherein said inward deflection of the contact causes said contact to engage an FTP cable, drain wire and wire foil or sheath.

22. A connector assembly according to claim 1, further comprising a printed circuit board, wherein said printed circuit board includes plug connection elements and terminals held between the jack housing and the first connector sub-assembly housing, and wherein at least one plug connection element aligns with the plug opening of the jack housing.

23. A connector assembly according to claim 22, further comprising a contact insert held between the jack housing and the printed circuit board.

24. A connector sub-assembly, comprising:

a. a routing cap that includes at least one routing channel, an opening sized and dimensioned to allow at least one wire pair to pass through said opening, and a cam opening sized and dimensioned to allow a cam member to pass through said cam opening;

b. a sub-assembly housing detachably coupled to said routing cap, wherein said sub-assembly housing includes a cylindrical member defining a cylindrical opening sized and dimensioned to allow at least one wire pair to pass through said opening, and a cam opening sized and dimensioned to allow a cam member to pass through said cam opening;

c. a cam nut mounted with respect to said cylindrical member, wherein said cam nut defines at least one cam thread, and wherein said at least one cam thread is configured and dimensioned to interact at least one cam slot; and d. a contact coupled with respect to the sub-assembly housing.

25. A connector sub-assembly according to claim 24, wherein rotation or translation of the cam nut results in deflection of said contact inward.

26. A connector sub-assembly according to claim 25, wherein said inward deflection of the contact causes said contact to engage an FTP cable, drain wire or wire foil or sheath.

27. A connector assembly, comprising:

a. a first connector sub-assembly including:

i. a jack housing defining a plug opening and a first opening;

ii. a connector sub-assembly housing detachably coupled to said jack housing in proximity to the first opening, wherein said first connector sub-assembly housing defines a cam member that includes a cam slot;

iii. a printed circuit board that includes a plurality of plug connection elements and terminals held between the jack housing and the first connector sub-assembly housing, and wherein at least one of said plurality of plug connection elements aligns with the plug opening of the jack housing; and iv. a contact insert held between the jack housing and the printed circuit board, and b. a second connector sub-assembly including:

i. a routing cap that includes at least one routing channel, an opening sized and dimensioned to allow at least one wire pair to pass through said opening, and a cam opening sized and dimensioned to allow a cam member to pass through said cam opening;

ii. a sub-assembly housing detachably coupled to said routing cap, wherein said second sub-assembly housing includes a cylindrical member defining a cylindrical opening sized and dimensioned to allow at least one wire pair to pass through said opening, and a cam opening sized and dimensioned to allow said cam member to pass through said cam opening;

iii. a cam nut mounted with respect to said cylindrical member, wherein said cam nut defines at least one cam thread, and wherein said at least one cam thread is configured and dimensioned to interact with said at least one cam slot; and iv. a contact coupled with respect to the sub-assembly housing, wherein said first connector sub-assembly is coupled to said second connector sub-assembly.

28. A connector assembly according to claim 27, wherein said first connector sub-assembly is coupled to said second connector sub-assembly by the rotation of the cam nut.

29. A connector assembly according to claim 28, wherein said rotation of the cam nut rotates the at least one cam thread causing said cam thread to interact with the at least one cam slot.

30. A connector assembly according to claim 29, wherein rotation of the cam nut further results in deflection of said contact inward.

31. A connector assembly according to claim 30, wherein said inward deflection of the contact causes said contact to engage an FTP cable, drain wire and wire foil or sheath.

32. In combination:

a. a jack housing defining a plug opening and a first opening;

b. a first connector sub-assembly housing detachably coupled to said jack housing in proximity to the first opening, wherein said first connector sub-assembly housing includes a cam member that defines a cam slot;

c. a routing cap that defines at least one routing channel, an opening sized and dimensioned to allow at least one wire pair to pass through said opening, and a first cam opening sized and dimensioned to allow said cam member to pass through said first cam opening;

d. a second sub-assembly housing detachably coupled to said routing cap, wherein said second sub-assembly housing includes a cylindrical member defining a cylindrical opening sized and dimensioned to allow at least one wire pair to pass through said opening, and a second cam opening sized and dimensioned to allow said cam member to pass through said second cam opening;

e. a cam nut mounted with respect to said cylindrical member, wherein said cam nut defines at least one cam thread, and wherein said at least one cam thread is configured and dimensioned to interact with said at least one cam slot; and f. a contact detachably coupled with respect to the second sub-assembly housing.

33. The combination according to claim 32, wherein rotation of the cam nut and cam threads securely couple first connector sub-assembly housing, routing cap, second connector sub-assembly housing and said cam nut.

34. The combination according to claim 33, wherein rotation of the cam nut further results in deflection of said contact inward.

35. The combination according to claim 34, wherein said inward deflection of the contact causes said contact to engage an FTP cable, drain wire and wire foil or sheath.

36. In combination:

a. a routing cap that includes at least one routing channel, an opening sized and dimensioned to allow at least one wire pair to pass through said opening, and a cam opening sized and dimensioned to allow a cam member to pass through said cam opening;

b. a sub-assembly housing detachably coupled to said routing cap, wherein said second sub-assembly housing includes a cylindrical member defining a cylindrical opening sized and dimensioned to allow at least one wire pair to pass through said opening, and a cam opening sized and dimensioned to allow said cam member to pass through said cam opening;

c. a cam nut mounted with respect to said cylindrical member, wherein said cam nut defines at least one cam thread, and wherein said at least one cam thread is configured and dimensioned to interact with said at least one cam slot; and d. a contact coupled with respect to the sub-assembly housing.

37. The combination according to claim 36, wherein rotation or translation of the cam nut results in deflection of said contact inward.

38. The combination according to claim 37, wherein said inward deflection of the contact causes said contact to engage an FTP cable, drain wire or wire foil or sheath.

39. A connector assembly, comprising:

a jack housing defining a plug opening;

a first housing in proximity to the jack housing;

a second housing including a cylindrical member defining a wire opening that is sized and dimensioned to allow at least one wire pair to pass therethrough;

a cam nut defining at least one cam thread mounted with respect to said cylindrical member; and a deflectable contact, wherein at least one of the jack housing and first housing define at least one cam member that defines a cam slot, and at least one of the first housing and second housing define a cam opening sized and dimensioned to allow said cam member to pass therethrough; and wherein said at least one cam thread is configured and dimensioned to interact with said cam slot such that rotation of the cam nut and said at least one cam thread securely couples one of the jack housing and first housing to the second housing and deflects said deflectable contact.

40. A connector assembly according to claim 39, wherein the connector assembly is shielded.

41. A connector assembly according to claim 39, wherein the deflectable contact engages an FTP cable, drain wire and wire foil or sheath when said deflectable contact is deflected.

42. A connector assembly according to claim 39, further comprising a printed circuit board, wherein said printed circuit board includes plug connection elements and terminals, and wherein at least one plug connection element aligns with the plug opening of the jack housing.

* * * * *